US005806381A

United States Patent [19]

Lin

[11] Patent Number: 5,806,381

[45] Date of Patent: Sep. 15, 1998

[54] RATCHET SCREW DRIVER ASSEMBLY

[76] Inventor: Ching Chou Lin, No. 33-12, Lane 320, Sec. 1, Sa Tien Road, Da Du Hsiang, Taichung Hsien, Taiwan

[21] Appl. No.: 821,229

[22] Filed: Mar. 20, 1997

[51] Int. Cl.[6] ..... B25B 13/00

[52] U.S. Cl. ..... 81/58.4; 81/451; 81/458

[58] Field of Search ..... 81/58.4, 451, 452, 81/456, 458, 125

[56] References Cited

U.S. PATENT DOCUMENTS

| | | | |
|---|---|---|---|
| 344,160 | 6/1886 | Brownson | 81/58.4 |
| 1,563,178 | 11/1925 | Fegley et al. | 81/63.2 |
| 1,712,196 | 5/1929 | Burger et al. | 81/451 |
| 2,304,271 | 12/1942 | Merriman et al. | 81/125 |
| 3,739,825 | 6/1973 | Knox | 81/451 |
| 3,901,298 | 8/1975 | Eby | 81/125 |
| 4,736,658 | 4/1988 | Jore | 81/451 |
| 4,787,278 | 11/1988 | Bononi | 81/452 |
| 5,211,086 | 5/1993 | Shu | 81/58.4 |
| 5,351,586 | 10/1994 | Habermehl et al. | 81/451 |

FOREIGN PATENT DOCUMENTS

| | | | |
|---|---|---|---|
| 2704170 | 10/1994 | France | 81/452 |
| 619794 | 3/1949 | United Kingdom | 81/458 |

*Primary Examiner*—David Scherbel
*Assistant Examiner*—Joni B. Danganan

[57] ABSTRACT

A ratchet screw driver includes a driving stem having a gear rotatably engaged in the bore of a handle and having a free end end for engaging with a fastener to be driven. A ratchet mechanism is engaged in the handle and engaged with the gear of the driving stem for selectively driving the driving stem. A barrel is rotatably engaged on the driving stem and movable along the driving stem for engaging around the fastener and for preventing the fastener from being tilted and for preventing the fastener from hurting the hand of the user.

2 Claims, 5 Drawing Sheets

RATCHET SCREW DRIVER ASSEMBLY

BACKGROUND OF THE INVENTION

1. Field of the Invention

The present invention relates to a screw driver, and more particularly to a ratchet screw driver assembly.

2. Description of the Prior Art

Typical ratchet screw drivers comprise a ratchet mechanism for controlling the driving directions of the driving stem which is provided for engaging with a fastener to be driven. However, nothing may be provided for retaining the fastener in place.

The present invention has arisen to mitigate and/or obviate the afore-described disadvantages of the conventional ratchet screw drivers.

SUMMARY OF THE INVENTION

The primary objective of the present invention is to provide a ratchet screw driver which includes a barrel for engaging with and for preventing the fastener from being tilted.

In accordance with one aspect of the invention, there is provided a ratchet screw driver assembly comprising a body including a bore, a driving stem including a first end having a gear rotatably engaged in the bore of the body and including a second end for engaging with a fastener to be driven and having an annular groove, ratchet means for engaging with the gear and for allowing the body to selectively drive the driving stem, a barrel rotatably engaged on the driving stem and adapted to be moved along the driving stem, and stop means for engaging the barrel to the driving stem and for preventing the barrel from being disengaged from the driving stem. The barrel may be engaged around the fastener for preventing the fastener from being tilted and for preventing the fastener from hurting the hand of the user. The barrel may be moved along the driving stem to a compact folded position for facilitating the storing and carrying purposes of the ratchet screw driver assembly.

The stop means includes an annular slot formed in the barrel, and includes a clamping ring engaged with the annular groove of the driving stem and for engaging with the annular slot of the barrel for preventing the barrel from being disengaged from the driving stem.

In an alternative embodiment the stop means includes an annular slot formed in the barrel, and includes a pair of resilient members each having a first end for engaging with the annular slot of the barrel and with the annular groove of the driving stem and for preventing the barrel from being disengaged from the driving stem.

The resilient members each includes a bent middle portion for engaging with the fastener and for preventing the fastener from being tilted.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
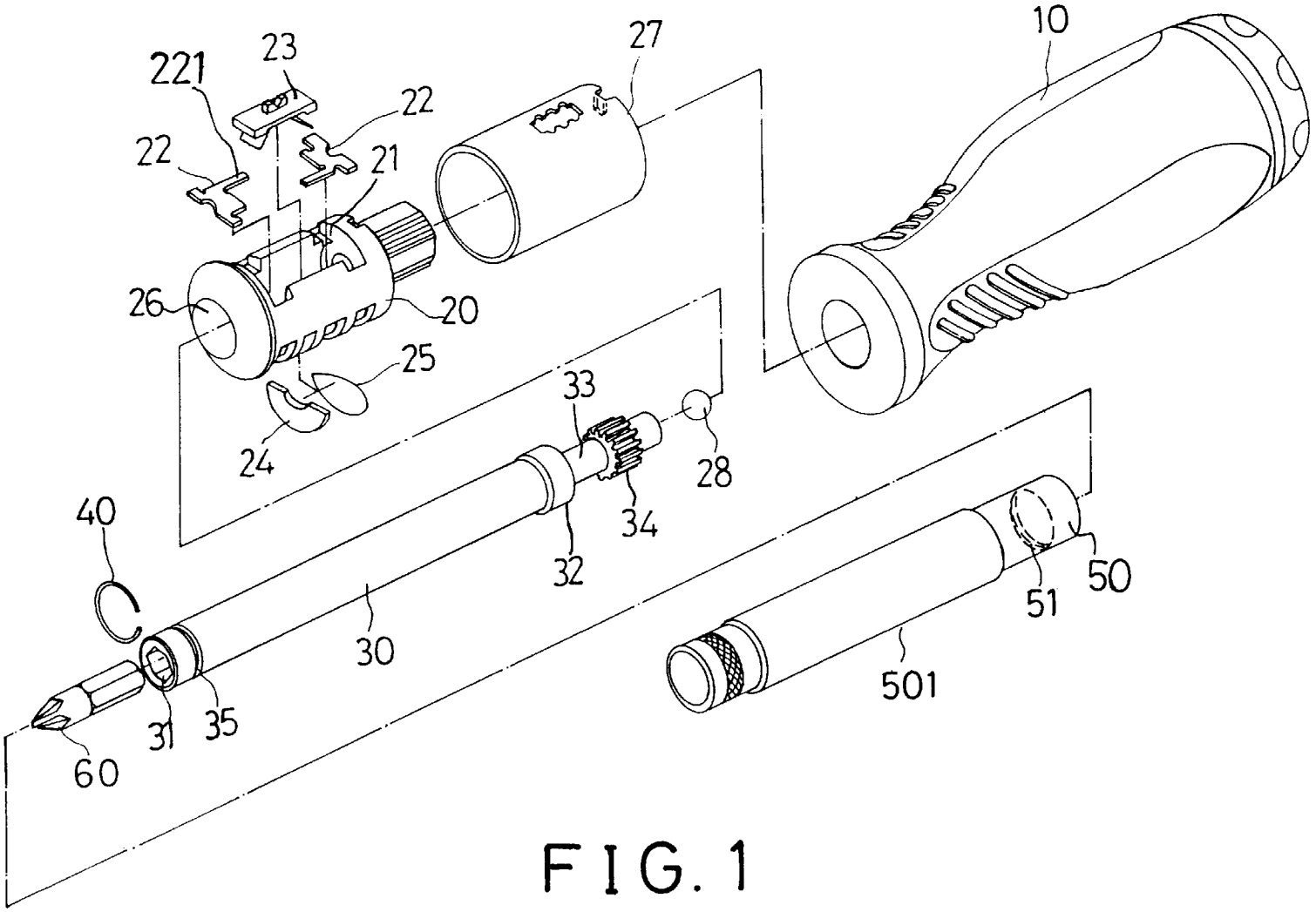
FIG. 1 is an exploded view of a ratchet screw driver in accordance with the present invention.
Figure 2:
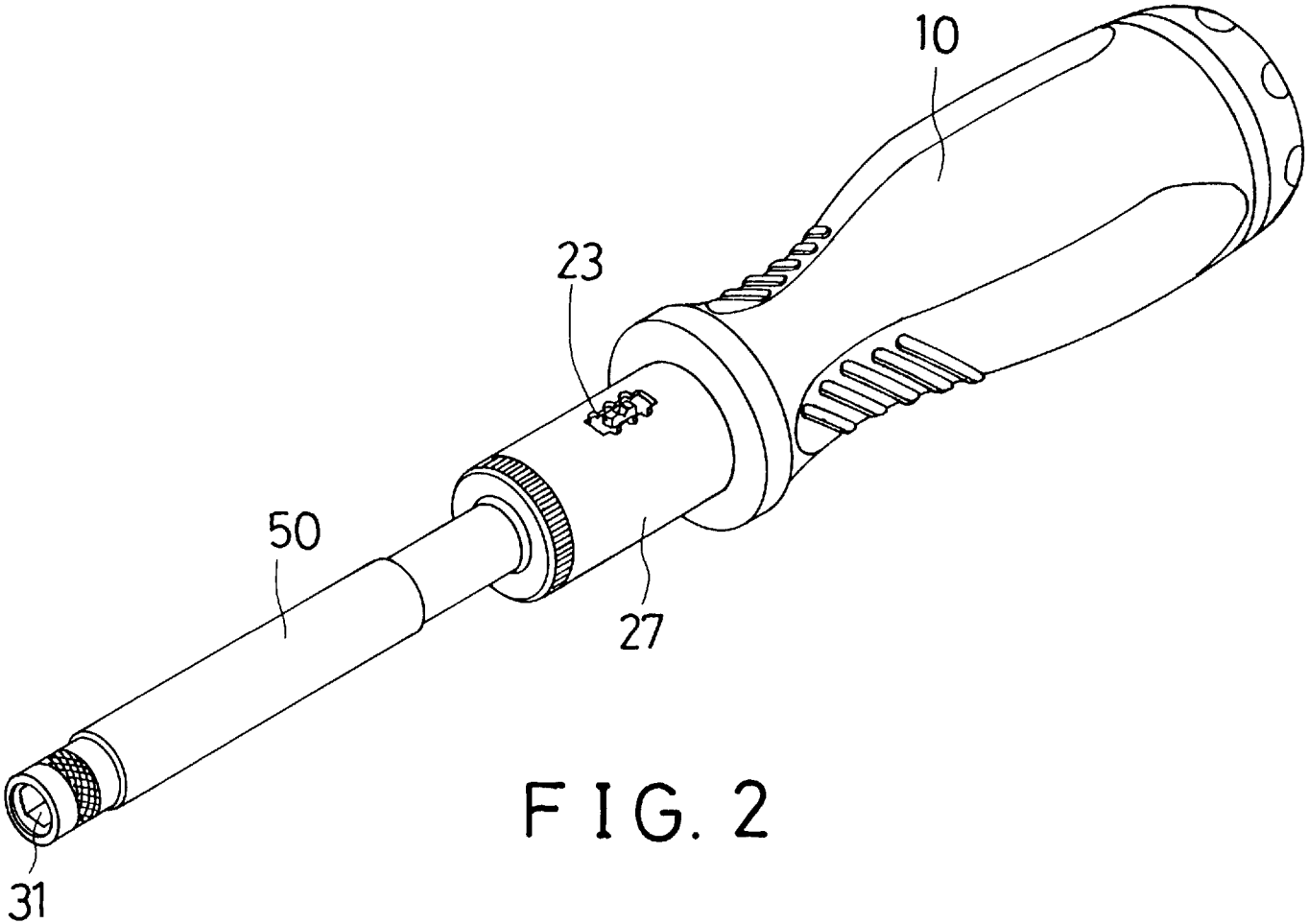
FIG. 2 is a perspective view of the ratchet screw driver.
Figure 3:
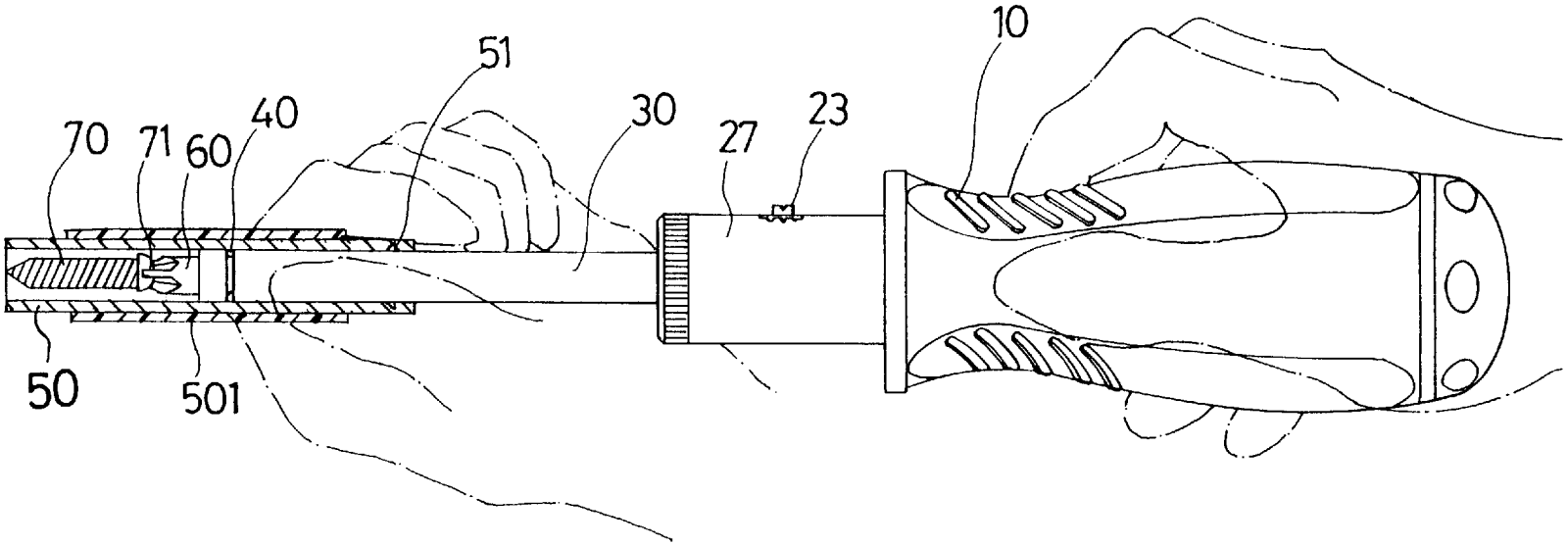
FIG. 3 is a partial cross sectional view illustrating the operation of the ratchet screw driver.

Referring to the drawings, and initially to FIGS. 1–3, a ratchet screw driver assembly in accordance with the present invention comprises a body 20 secured to a handle 10. The body 20 includes a bore 26 and a chamber 21 communicating with each other. A driving stem 30 includes an extension 33 of reduced diameter rotatably received in the bore 26 of the body 20 and an annular ring 32 engaged with the body 20 for preventing the driving stem 30 from being tilted relative to the body 20. The extension 33 includes a gear 34. A ball 28 is engaged between the extension 33 and the body 20. A stop 24 and a spring blade 25 are engaged in the body 20 and engaged with the gear 34 for resiliently and rotatably retaining the gear 34 in the bore 26. A pair of pawls 22 are disposed in the chamber 21 and each includes a leg 221 for engaging with the gear 34 and for controlling the driving directions of the driving stem 30. A knob 23 is provided for forcing either or both of the pawls 22 to engage with the gear 34. A cover 27 is engaged on the body 20 for retaining the pawls 22 and the knob 23 in place. The above ratchet mechanism is typical and will not be described in further details.

The driving stem 30 includes an engaging hole 31 formed in one end for engaging with a tool bit 60 which may engage with the fastener to be rotated. The driving stem 30 includes an annular groove 35 for engaging with a retaining ring 40. A barrel 50 is rotatably engaged on the driving stem 30 and includes a wedge shaped annular slot 51 (FIG. 3) for engaging with the retaining ring 40 and for preventing the barrel 50 from being disengaged from the driving stem 30. It is to be noted that wedge shaped annular slot 51 allows the barrel 50 to move toward the body 20 for reducing the length of the screw driver assembly and for allowing the screw driver assembly to be easily carried and stored. A protective or resilient outer sleeve 501 is engaged on the barrel 50 for facilitating the grasping of the barrel 50. The sleeve 501 may include a knurled outer surface for further facilitating the grasping of the barrel 50.

In operation, as shown in FIG. 3, the tool bit 60 may engage with the engaging recess 71 of the fastener 70 and may be provided for rotating the fastener 70. The barrel 50 may be engaged around the fastener 70 for preventing the fastener 70 from being tilted and for retaining the fastener 70 in place. The hand of the user may also be prevented from being hurt by the fastener 70 when the fastener 70 is tilted.

Figure 4:
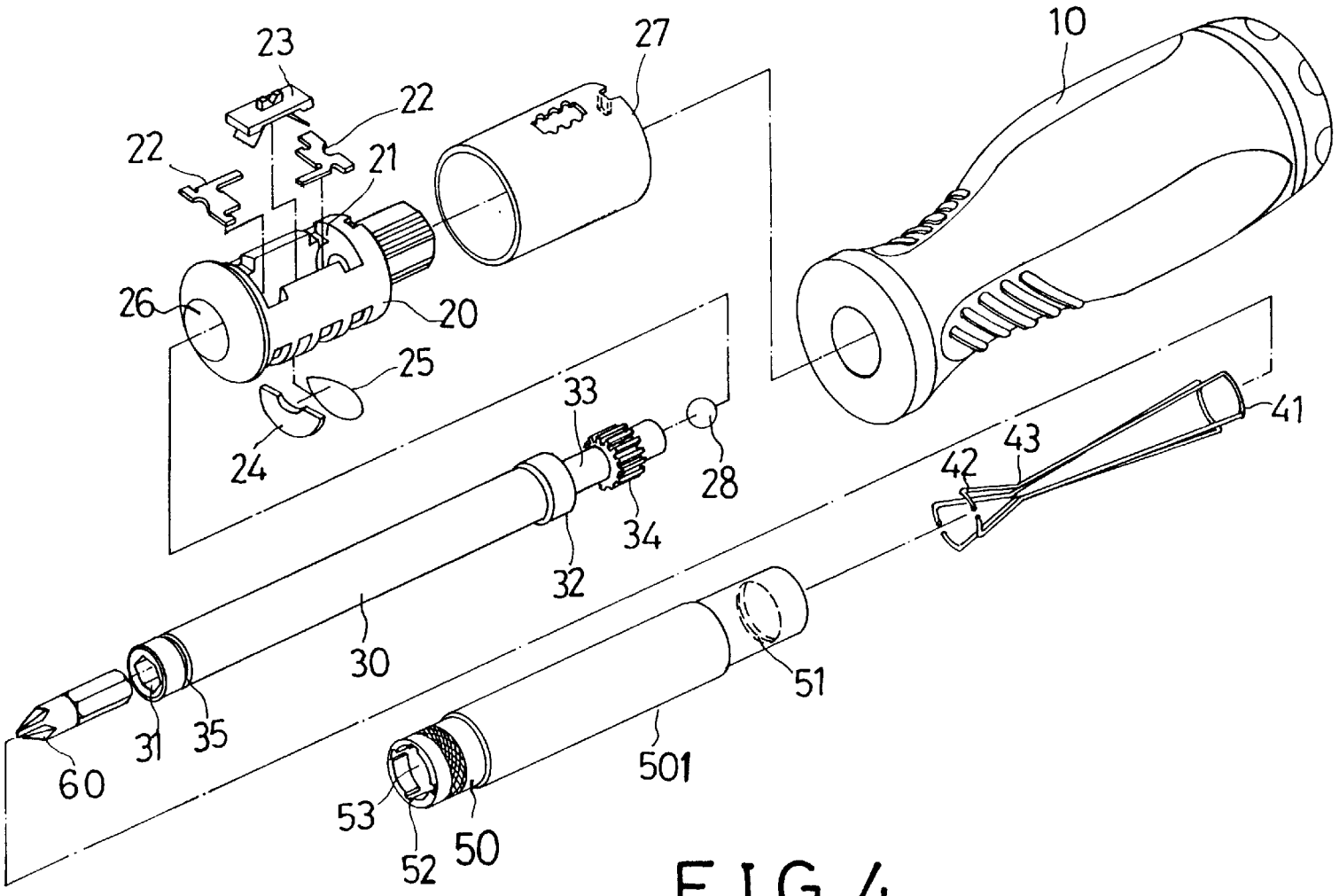
FIG. 4 is an exploded view illustrating another application of the ratchet screw driver assembly.
Figure 5:
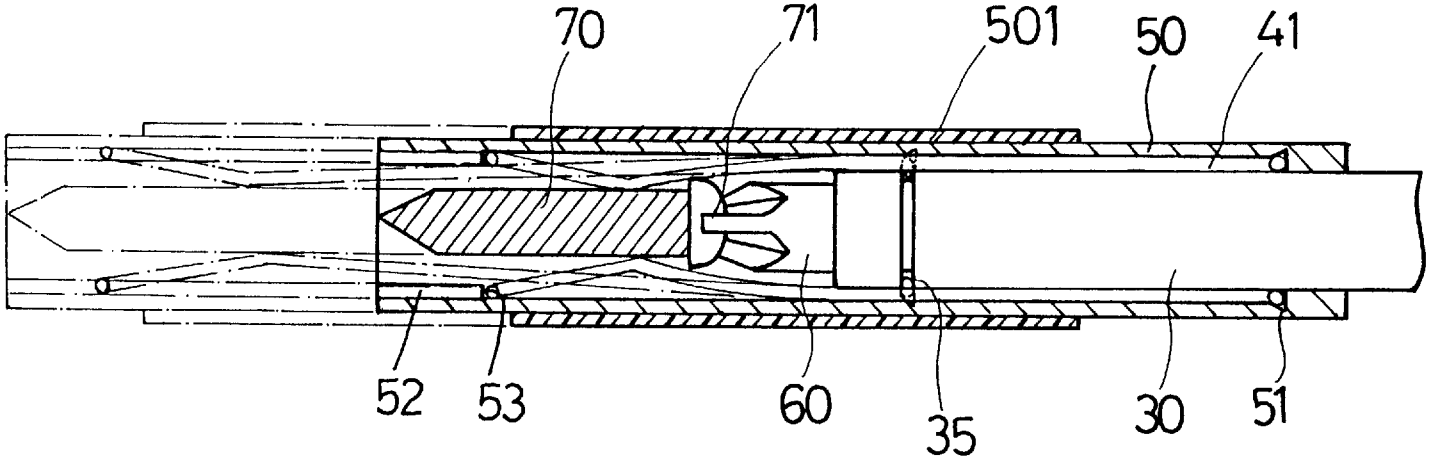
FIG. 5 is an enlarged partial cross sectional view illustrating the operation of the ratchet screw driver assembly as shown in FIG. 4.

Referring next to FIGS. 4 and 5, instead of the clamping ring 40 as shown in FIGS. 1 and 3, a pair of resilient members 41 are engaged between the driving stem 30 and the barrel 50 and each includes one end for engaging with the annular slot 51 of the barrel 50 and the annular groove 35 of the driving stem 30 and for preventing the barrel 50 from being disengaged from the driving stem 30. The barrel 50 includes an annular shoulder 53 and four notches 52 for engaging with the end portions 42 of the resilient member 41. The resilient members 41 each includes a bent middle portion 43 for biasing against the fastener 70 and for retaining the fastener 70 in place.

Accordingly, the ratchet screw driver assembly in accordance with the present invention includes a barrel for engaging with and for preventing the fastener from being tilted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet screw driver assembly comprising:

a body including a bore, a driving stem including a first end having a gear rotatably engaged in said bore of said body and including a second end for engaging with a fastener to be driven and having an annular groove, ratchet means for engaging with said gear and for allowing said body to selectively drive said driving stem, a barrel rotatably engaged on said driving stem and adapted to be moved along said driving stem, said barrel including an annular slot formed therein, and stop means for engaging said barrel to said driving stem, said stop means including a pair of resilient members each having a first end for engaging with said annular slot of said barrel and for engaging with said annular groove of said driving stem and for preventing said barrel from being disengaged from said driving stem, said resilient members each including a bent middle portion for engaging with the fastener and for preventing the fastener from being tilted.

2. The ratchet screw driver assembly according to claim 1, wherein said annular slot of said barrel is wedge-shaped.

* * * * *